US007086359B2

(12) United States Patent
Hayase et al.

(10) Patent No.: US 7,086,359 B2
(45) Date of Patent: Aug. 8, 2006

(54) ROTATIONAL PHASE ADJUSTER

(75) Inventors: Isao Hayase, Tsuchiura (JP); Atsushi Watanabe, Mito (JP); Shigeaki Yamamuro, Zushi (JP); Masahiko Watanabe, Yokohama (JP); Yoshiyuki Kobayashi, Atsugi (JP); Atsushi Yamanaka, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/131,361

(22) Filed: May 18, 2005

(65) Prior Publication Data

US 2005/0257761 A1 Nov. 24, 2005

(30) Foreign Application Priority Data

May 19, 2004 (JP) ..... 2004-149689

(51) Int. Cl.
*F01L 1/34* (2006.01)

(52) U.S. Cl. ..... 123/90.17; 123/90.15; 123/90.16; 123/90.31

(58) Field of Classification Search ..... 123/90.17, 123/90.16
See application file for complete search history.

(56) References Cited

U.S. PATENT DOCUMENTS 5,172,658 A * 12/1992 Hampton ..... 123/90.17
5,172,660 A * 12/1992 Hampton ..... 123/90.17
5,172,662 A * 12/1992 Hampton ..... 123/90.17
5,235,941 A * 8/1993 Hampton ..... 123/90.17
5,337,711 A * 8/1994 Hampton ..... 123/90.17

FOREIGN PATENT DOCUMENTS

| | | |
|---|---|---|
| JP | 06-010964 | 1/1994 |
| JP | 06-010965 | 1/1994 |
| JP | 06-010966 | 1/1994 |

* cited by examiner

*Primary Examiner*—Thomas Denion
*Assistant Examiner*—Kyle M. Riddle
(74) *Attorney, Agent, or Firm*—Antonelli, Terry, Stout and Kraus, LLP.

(57) ABSTRACT

In a rotational phase adjusting apparatus for adjusting a difference in rotational phase between a first element and a second element by controlling an engagement therebetween through a third element whose condition is set by a movement of a fourth element, an elastic member is arranged between the fourth element and the one of the first and second elements, and a brake generates a variable braking force to be applied to the fourth element so that a rotational positional relationship between the fourth element and the one of the first and second elements and a value of a force applicable from the fourth element to the third element are elastically variable in accordance with a value of the variable braking force.

17 Claims, 10 Drawing Sheets

ROTATIONAL PHASE ADJUSTER

BACKGROUND OF THE INVENTION

The present invention relates to an apparatus for adjusting a difference in rotational phase between first and second rotary members, particularly suitable for adjusting an opening and closing timing of an intake valve or exhaust valve driven by a crank shaft through a cam shaft in an internal combustion engine.

In prior art cam shaft phase adjustors for internal combustion engines as disclosed by JP-A-6-10964, JP-A-6-10965 and JP-A-6-10966, an engagement between a first rotary member driven by a crank shaft and a second rotary member fixed to a cam shaft can be selectively released to adjust a difference in rotational phase between the crank shaft and the cam shaft, by a plunger moved by an electromagnetic or hydraulic actuator.

BRIEF SUMMARY OF THE INVENTION

An object of the present invention is to provide an apparatus for adjusting a difference in rotational phase between first and second rotary members, in which apparatus a major part of energy for adjusting the difference in rotational phase can be taken from a rotational energy to be transmitted through the apparatus so that an energy other than the rotational energy to be input into the apparatus can be decreased.

In a rotational phase adjusting apparatus for adjusting a difference in rotational phase between a rotating member and a driven member rotationally driven by the rotating member, comprising a first element capable of being connected to the rotating member so that the first element is rotationally driven by the rotating member, a second element capable of being connected to the first element and the driven member so that the driven member is rotationally driven through the second element by the first element, a third element capable of being set at either (one desired or selected as occasion demands) of a first condition at which first condition the third element is pressed against or compressed between the first and second elements to prevent the first and second elements from rotating with respect to each other and a second condition at which second condition the third element is released (separated or free in force transmission to the third element) from at least one of the first and second elements to allow the first and second elements to rotate with respect to each other, and a fourth element rotatable (coaxially) with respect to one of the first and second elements (may be rotatable with respect to the other one of the first and second elements) and facing ("facing" may include "directly connected to urge the third element", "connected or holding with a gap or backlash to keep the condition of the third element" and not constraining with the gap or clearance to keep the third element's self aligning condition) to the third element (to change a force applied from the fourth element to the third element to be positioned by the fourth element with respect to at least one of the first and second elements and/or to position the third element with respect to at least one of the first and second elements or allow the third element to be released from the at least one of the first and second elements) (the fourth element needs to apply the force therefrom to the third element when the fourth element allows the third element to be released from the at least one of the first and second elements and the fourth element does not need to apply the force therefrom to the third element when the fourth element allows the third element to be compressed between the first and second elements, or alternatively the fourth element does not need to apply the force therefrom to the third element when the fourth element allows the third element to be released from the at least one of the first and second elements and the fourth element needs to apply the force therefrom to the third element when the fourth element allows the third element to be compressed between the first and second elements. Which of these alternative two situations is performed is determined by a direction of an elastic force urging the third element.) so that the fourth element is capable of setting the third element (setting includes forcing the third element with urging force from the fourth element to be applied to the third element to be set at the third element's forced condition (at which forced condition the third element is kept by the fourth element to be released from the at least one of the first and second elements to allow the first and second elements to rotate with respect to each other when the urging force is applied from the fourth element to the third element) such as the second condition in the invention) and allowing the third element without the urging force (from the fourth element) to be set at the third element's self aligning condition (at which self aligning condition the third element is stable or stationary between the first and second elements when the urging force is not applied from the fourth element to the third element) such as the first condition in the invention) at selected one of the first and second conditions, according to the invention, the apparatus further comprises:

an elastic member arranged between the fourth element and the one of the first and second elements to enable a rotational positional relationship between the fourth element and the one of the first and second elements to be elastically variable, and a brake for generating a variable braking force ("variable" may include a change of braking torque to zero) to be applied to the fourth element so that the rotational positional relationship between the fourth element and the one of the first and second elements and a value of a force applicable from the fourth element to the third element (for setting the third element at selected one of the first and second conditions) (the force applicable from the fourth element to the third element corresponds to a difference between the braking force and an elastic reaction or counter-action force of the deformed elastic member which elastic reaction or counter-action force changes in accordance with a value of the elastically variable rotational positional relationship between the fourth element and the one of the first and second elements) are elastically variable in accordance with a value of the variable braking force (so that the fourth element is capable of setting the third element at selected one of the first and second conditions by changing the value of the force applicable from the fourth element to the third element or changing the value of the variable braking force (the force applicable from the fourth element to the third element changes in accordance with the difference between the braking force and the elastic reaction or counter-action force of the deformed elastic member which elastic reaction or counter-action force changes in accordance with the value of the elastically variable rotational positional relationship between the fourth element and the one of the first and second elements) and the rotational positional relationship between the fourth element and the one of the first and second elements can be set desirably by changing the value of the variable braking force) when the first element is rotationally driven by the rotating member, the fourth element is rotationally driven by the one of the first and second elements through the elastic member (through the elastically variable rotational positional relationship between the first element and the third element) and the fourth element is braked by the variable braking force (against a rotational torque of the rotating member). (Only when the fourth element is rotated, the braking force to be applied to the fourth element can be generated.)

Since the rotational positional relationship between the fourth element and the one of the first and second elements and the value of the force applicable from the fourth element to the third element can be changed by changing the value of the variable braking force, engagement and disengagement between the first and second elements through the third elements can be switched by changing the value of the variable braking force so that a major part of energy for adjusting the difference in rotational phase can be taken from a rotational energy to be transmitted through the apparatus and an energy other than the rotational energy to be input into the apparatus can be decreased.

If a relative rotational movement between the fourth element and the other one of the first and second elements (the fourth element and the other one of the first and second elements being coaxial with respect to each other) is limited (by a structure as shown in embodiments of the invention or a direct mechanical engagement between the fourth element and the other one of the first and second elements) in a predetermined degree (so that a difference in rotational phase between the first and second elements corresponds substantially (with a mechanically necessary backlash of the predetermined degree) to a difference in rotational phase between the fourth element and the one of the first and second elements changing in accordance with the value of the variable braking force, that is, the rotational positional relationship between the fourth element and the one of the first and second elements adjusted by changing the value of the variable braking force), the difference in rotational phase between the first and second elements can be variable continuously in proportion to the value of the variable braking force. If the rotating member is a crank shaft of a (internal) combustion engine, the driven member is a cam shaft of the combustion engine, and the elastic element is arranged between the fourth element and the one of the first and second elements in such a manner that a force generated by the elastic element to be applied through the fourth element to the other one of the first and second elements (between the one of the first and second elements and the other one of the first and second elements) is capable of rotating the other one of the first and second elements with respect to the one of the first and second elements to rotate the first element forward with respect to the second element in a rotary direction of the first element (to form a rotational phase lag of the second element behind the first element), when the braking force is not more than a predetermined value (including zero), a start of operation or rotation of the engine can be performed or maintained even when the braking force is not more than the predetermined value (including zero), for example, the brake is broken. For performing or maintaining the start of operation or rotation of the engine even when the braking force is not more than the predetermined value (including zero), for example, the brake is broken, it is preferable that a difference or change in rotational phase between the first and second elements is limited in a predetermined degree.

If the rotating member is a crank shaft of a (internal) combustion engine, the driven member is a cam shaft of the combustion engine, and the force generated by the elastic element to be applied from the fourth element to the third element (between the one of the first and second elements and the third element) sets the third element at the second condition to allow the first element to rotate forward with respect to the second element in a rotary direction of the first element (to form a rotational phase lag of the second element behind the first element), when the braking force is not more than a predetermined value (including zero), the start of operation or rotation of the engine can be performed or maintained even when the braking force is not more than the predetermined value (including zero), for example, the brake is broken.

The apparatus may comprise a pair of the third elements, one of which third elements capable of being set at either (one desired or selected as occasion demands) of the first condition at which first condition the third element is pressed against or compressed between the first and second elements to prevent the first element from rotating forward with respect to the second element in a rotary direction of the first element (to prevent a rotational phase lag of the second element behind the first element) and the second condition at which second condition the third element is released (separated or free in force transmission to the third element) from at least one of the first and second elements to allow the first element to rotate forward with respect to the second element in the rotary direction of the first element (to form the rotational phase lag of the second element behind the first element), and the other one of which third elements capable of being set at either (one desired or selected as occasion demands) of the first condition at which first condition the third element is pressed against or compressed between the first and second elements to prevent the first element from rotating backward with respect to the second element in the rotary direction of the first element (to prevent a rotational phase advance of the second element beyond the first element) and the second condition at which second condition the third element is released (separated or free in force transmission to the third element) from at least one of the first and second elements to allow the first element to rotate backward with respect to the second element in the rotary direction of the first element (to form the rotational phase advance of the second element beyond the first element). It is preferable for switching the rotatable direction and disengage-and-engage between the first and second elements in accordance with the movement of the fourth element or the change in value of the force applied from the fourth element to the third member that the fourth element faces to each of the third elements so that the fourth element is capable of setting the one of the third elements at selected one of the first and second conditions and setting the other one of the third elements at the other one of the first and second conditions other than the selected one of the first and second conditions (to prevent rotation between the first and second elements in selected one rotational direction when rotation therebetween in another rotational direction opposite to the selected one rotational direction is allowed), and the value of the force applicable from the fourth element to the third elements is variable in accordance with the value of the braking force to set the third elements at respective ones of the first and second conditions different from (or opposite to) each other (so that the one of the third elements is set at selected one of the first and second conditions and the other one of the third elements is set at the other one of the first and second conditions other than the selected one of the first and second conditions). If the fourth element faces to each of the third elements so that the fourth element is (further) capable of setting each of the third elements at the first condition (to prevent rotation between the first and second elements in both of the rotational directions opposite to each other), the value of the force applicable from the fourth element to the third elements is variable in accordance with the value of the braking force to set each of the third elements at the first condition, and the value of the force applicable from the fourth element to the third elements when each of the third elements is set at the first condition is an intermediate value between the value of the force applicable from the fourth element to the third elements when the one of the third elements is set at the first condition and the other one of the third elements is set at the second condition and the value of the force applicable from the fourth element to the third elements when the one of the third elements is set at the second condition and the other one of the third elements is set at the first condition (so that a first state in which the rotation between the first and second elements in one of the rotational directions opposite to each other is prevented and the rotation therebetween in the other one of the rotational directions is allowed, a second state in which the rotation between the first and second elements in both of the rotational directions is prevented, and a third state in which the rotation between the first and second elements in one of the rotational directions opposite to each other is allowed and the rotation therebetween in the other one of the rotational directions is prevented is selected continuously and desirably by changing the value of the variable braking force corresponding to the force applicable from the fourth element to the third elements), either of rotational phase lag and advance between the first and second elements, and a difference maintenance in rotational phase between the first and second elements can be selected desirably by changing the value of the braking force.

The rotating member may be a crank shaft of a (internal) combustion engine, the driven member may be a cam shaft of the combustion engine. If the fourth element (urged by the elastic element) sets the one of the third elements at the second condition thereof, and sets the other one of the third elements at the first condition thereof (so that the rotational phase lag of the second element or cam shaft behind the first element or crank shaft is allowed and the rotational phase advance of the second element or cam shaft beyond the first element or crank shaft is prevented), when the braking force is not more than a predetermined value (including zero), the start of operation or rotation of the engine can be performed or maintained even when the braking force is not more than the predetermined value (including zero), for example, the brake is broken.

If the apparatus further comprises another elastic element between the third elements of the pair to urge the third elements toward each of the first and second elements in respective directions opposite to each other (so that the third elements are urged by the another elastic element to the respective first conditions to prevent the relative rotation between the first and second elements in both rotational directions opposite to each other when the third elements are not set by the fourth elements at the respective first conditions and/or the respective second conditions), the third elements can be kept stably at the respective first conditions and/or the respective second conditions when the third elements are not set by the fourth elements.

If the apparatus further comprises a lever swingable on an axis arranged on one of the first and second elements, wherein a distance between the axis and a point on the lever at which point the braking force is applied from the brake to the lever is larger than a distance between the axis and another point on the lever at which point the braking force is applied to the fourth element from the lever so that a force amplified in comparison with the braking force generated by the brake is applied to the fourth element, the energy other than the rotational energy to be input into the apparatus can be further decreased.

The first and second elements may form an wedge shaped clearance therebetween into which the third element is pressed to be compressed between the first and second elements at the first condition, and from which the third element is released to be released from at least one of the first and second elements at the second condition.

The fourth element may be rotatable with respect to the first element, and the elastic member may be arranged between the fourth element and the first element. If a relative rotational movement between the fourth element and the second element is limited in a predetermined degree, the difference in rotational phase between the first and second elements can be variable continuously in proportion to the value of the variable braking force.

The fourth element may be rotatable with respect to the second element, and the elastic member may be arranged between the fourth element and the second element. If a relative rotational movement between the fourth element and the first element is limited in a predetermined degree, the difference in rotational phase between the first and second elements can be variable continuously in proportion to the value of the variable braking force.

The fourth element may extend (in a direction parallel to a rotational axis direction of the coaxial first and second elements) through the other one of the first and second elements with a clearance between the fourth element and the other one of the first and second elements so that the braking force is transmitted to the fourth element through the other one of the first and second elements.

Other objects, features and advantages of the invention will become apparent from the following description of the embodiments of the invention taken in conjunction with the accompanying drawings.

DETAILED DESCRIPTION OF THE INVENTION

Figure 1:
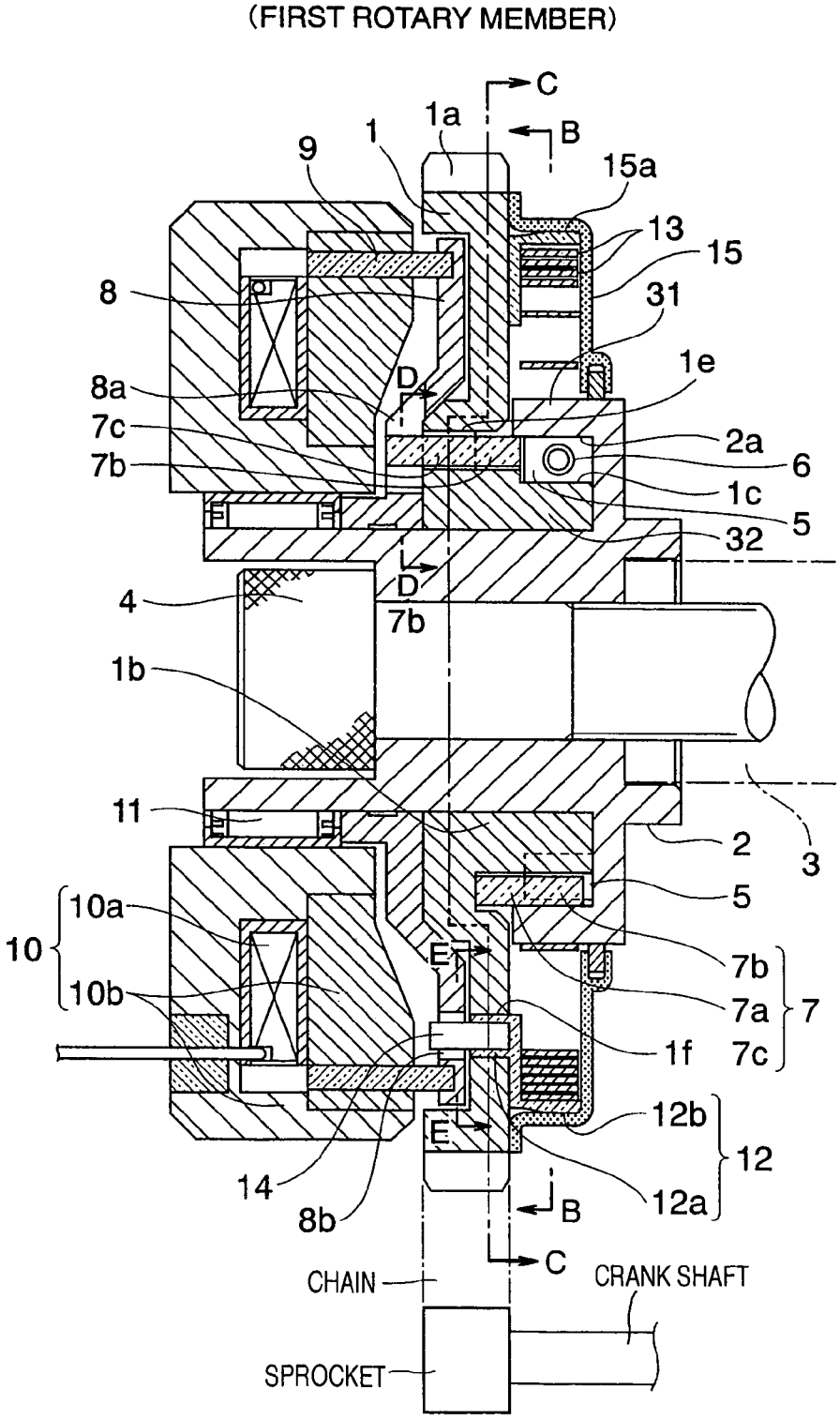
FIG. 1 is a cross sectional side view of a cam shaft rotational phase adjusting device as a first embodiment of the invention in which a brake pad pressing force is not generated.
Figure 2:
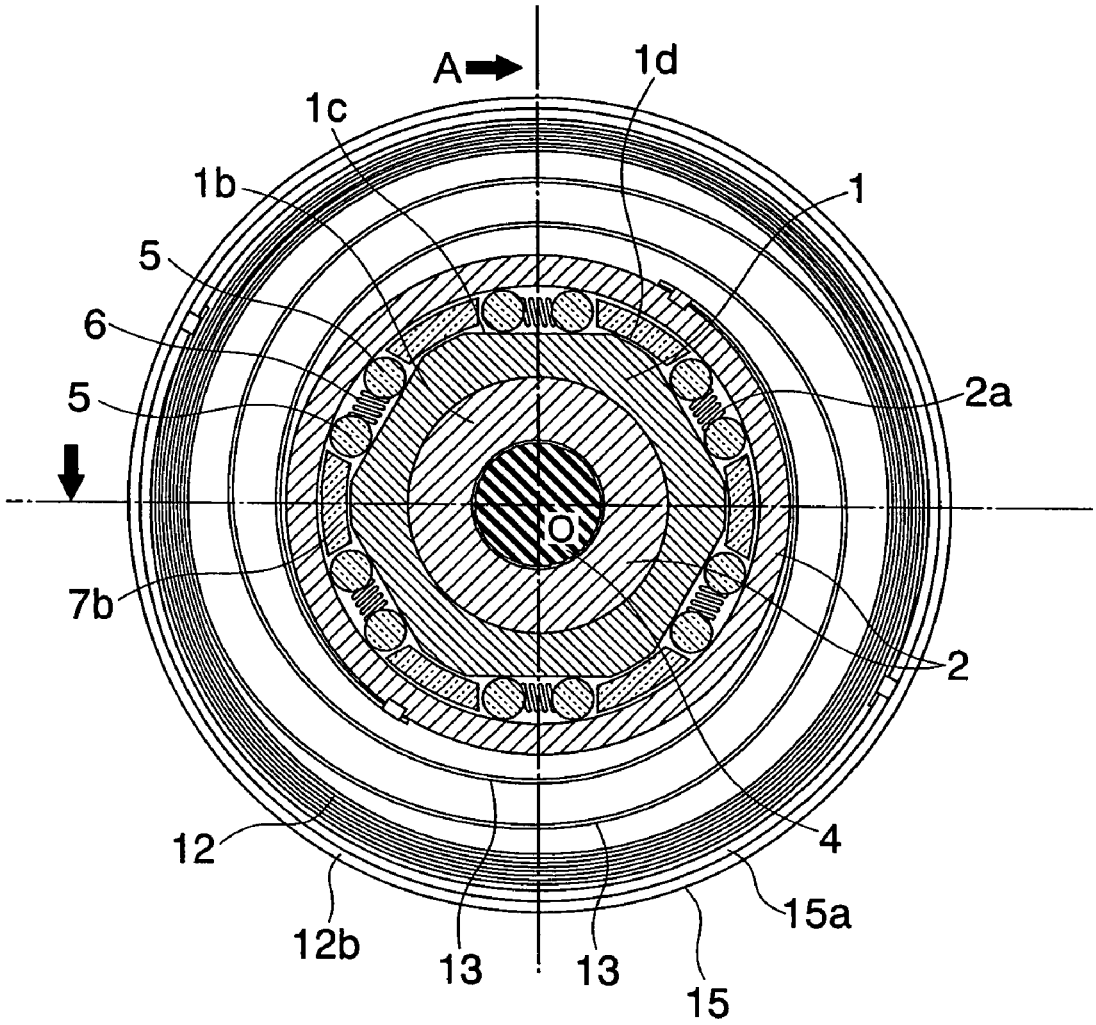
FIG. 2 is a cross sectional view of the cam shaft rotational phase adjusting device as the first embodiment of the invention, taken along B—B in FIG. 1.
Figure 3:
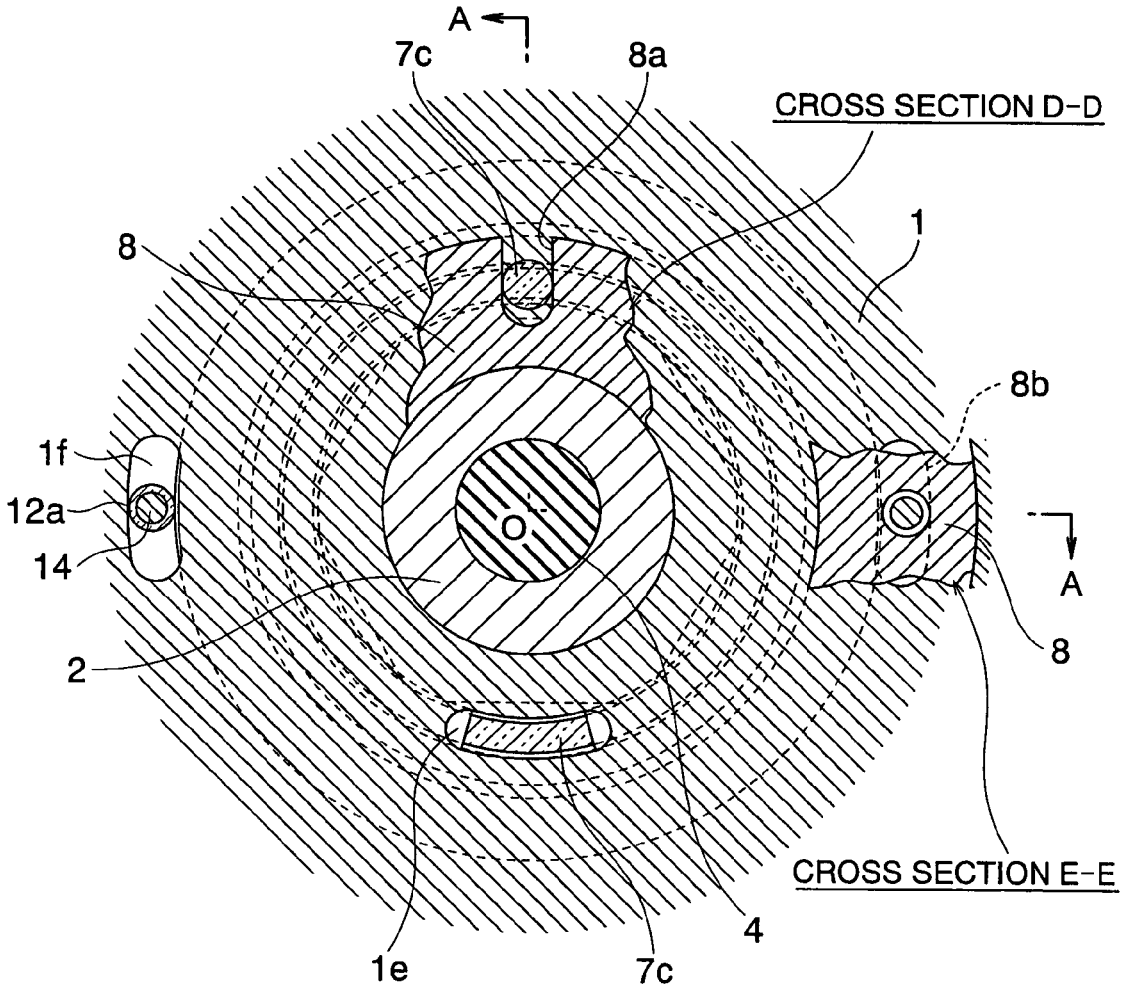
FIG. 3 is a cross sectional view of the cam shaft rotational phase adjusting device as the first embodiment of the invention, taken along C—C, D—D and E—E in FIG. 1.
Figure 4:
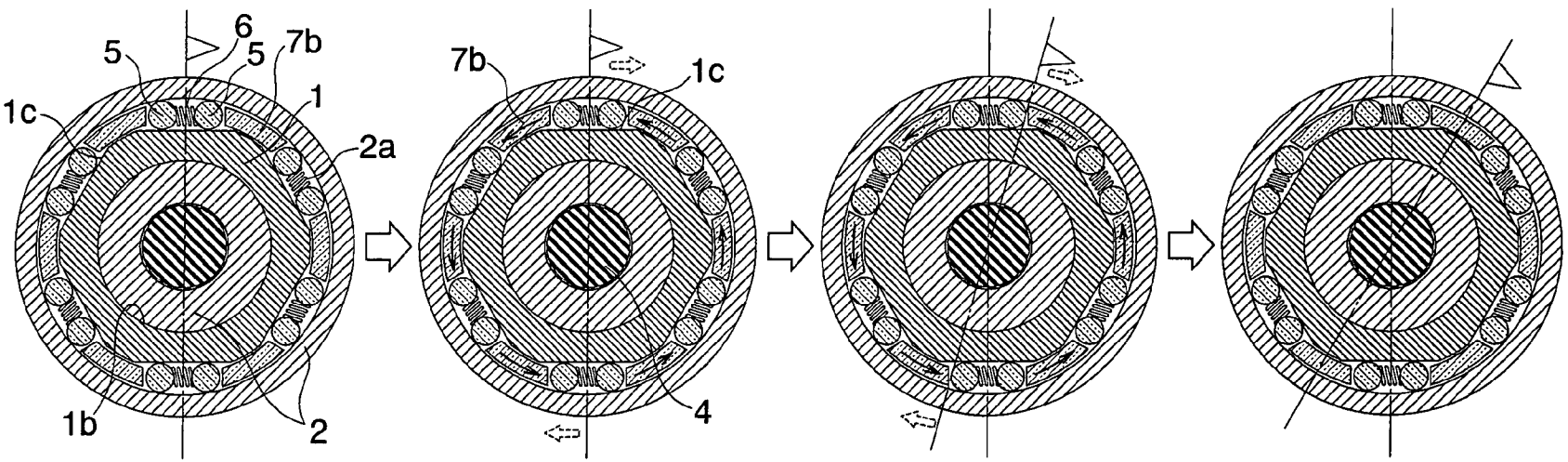
FIG. 4 is an explanation view showing a process of changing the cam shaft phase to a rotational phase advance in the first embodiment of the invention.
Figure 5:
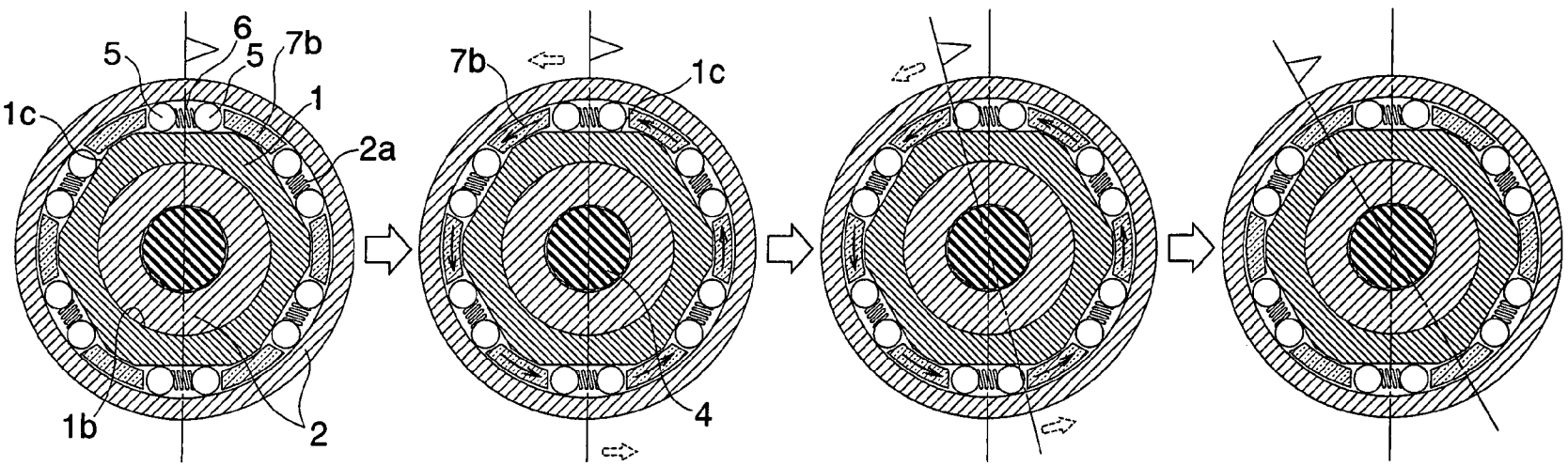
FIG. 5 is an explanation view showing a process of changing the cam shaft phase to a rotational phase lag in the first embodiment of the invention.

Hereafter, a cam shaft phase adjusting device for an internal combustion engine as a first embodiment of the invention is explained with making reference to FIGS. 1–5. FIGS. 1–3 are views for explaining structure of the first embodiment of the invention. FIG. 1 is a side cross sectional view of the first embodiment taken along A-O-A of FIG. 2, and FIG. 2 is a transverse cross sectional view of the first embodiment taken along B—B of FIG. 1. FIG. 3 is a transverse cross sectional view of the first embodiment, taken along C—C, D—D and E—E in FIG. 1. Each of FIGS. 4 and 5 is a view for explaining a control process of the cam shaft phase in the first embodiment, FIG. 4 is a view for explaining a process of changing the cam shaft phase to a rotational phase advance, and FIG. 5 a view for explaining a process of changing the cam shaft phase to a rotational phase lag.

In FIGS. 1–3, a sprocket 1 as a first rotary element is rotationally driven through a chain (not shown) engaging with its outer peripheral teeth by a crank shaft of an engine with ½ reduction. A body 2 as a second rotary element is fixed by a fixing bolt 4 to a front end of a cam shaft 3 indicated by an alternate long and short dash line. The sprocket 1 is rotationally supported at its bearing portion 1*b* by the body 2, and both are coaxially arranged to be enabled to relatively movable only rotationally. The sprocket 1 has an axially extending cylindrical protruding portion 32 whose outer peripheral side has a cam surface 1*d* including a plurality of flat surface portions 1*c*. The body 2 has a key-shape portion 31, and an end of a return spring 13 as a rotary spring is fixed to an outer periphery of the key-shape portion 31. An inside of the key-shape portion of the body 2 has a cylindrical surface portion 2*a* facing radially inward to the flat surface portions 1*c* of the cylindrical protruding portion. A pair of cylindrical shim elements 5 is arranged in a clearance between each of the flat surface portions 1*c* and the cylindrical surface portion 2*a*, and a spring member 6 is arranged between the cylindrical shim elements 5 of each pair. The spring member 6 pressing the cylindrical shim elements 5 to be separated from each other so that the flat surface portion 1*c* and the cylindrical surface portion 2*a*, that is, the sprocket 1 and the body 2 cannot rotationally move with respect to each other when each of the cylindrical shim elements 5 is pressed in a direction in which a distance between the flat surface portion 1*c* and the cylindrical surface portion 2*a* decreases so that a wedge engagement is formed. Comb teeth portions 7*b* of a keeper 7 as a fourth rotary element are arranged in intermediate positions between the flat surface portions 1*c* adjacent to each other. The keeper 7 has a ring-shaped portion 7*a*, comb teeth portions 7*b* extending axially from the ring-shaped portion, and a torque transmission portion 7*c* protruding axially from the ring-shaped portion to a reverse side of the sprocket through a first communication window 1*e* of the sprocket 1. The comb teeth portions 7*b* of the keeper 7 move in a circumferential direction with respect to the can surface 1*d* to press the shim elements to be released from its wedge engagement.

A brake disk 8 is rotatably supported by the body 2, and a hysteresis ring 9 is fixed to the brake disk 8. A stator 10 of a hysteresis brake is rotatable with respect to the body 2 through a needle bearing 11, and includes a magnetically energizing coil 10*a* and a yoke portion 10*b* facing to both sides of the hysteresis ring 9 without contact between the yoke portion 10*b* and each of the sides. The stator is rotatable with respect to the body 2, that is, the cam shaft, but is prevented by a holding means (not shown) from rotating with respect to a stationary coordinate system. The brake disk 8, hysteresis ring 9 and stator 10 form a hysteresis brake so that a value of a braking torque against the rotation of the brake disk 8 and hysteresis ring 9 is adjusted by changing a value of an electric current supplied to the magnetically energizing coil 10*a*.

A torque transmission part 7*c* of the keeper 7 is received by a notch portion 8*a* of the brake disk 8 so that the torque against the rotation of the keeper 7 as a fourth rotary element is generated by the hysteresis brake.

At a side of the brake disk 8 opposite to the sprocket 1, an end of the return spring 13 of spiral spring type is fixed to the body 2 on which the cylindrical surface 2*a* is formed, and another end of the return spring 13 is fixed to a return spring holder 12. In this embodiment, the return springs 13 of a pair are arranged mutually symmetrically with respect to the rotational axis of the body 2. The return spring holder 12 has a pair of projections 12*a* projecting into second communicating windows 1*f* of the sprocket 1 respectively. Torque transmission pins 14 are fixed to the projections 12*a* respectively, and extend through the sprocket 1 to be fitted into elongated hole 8*b* of the brake disk 8. The return spring holder 12 and return spring 13 are contained by a cover 15 fixed to the sprocket 1, and a spherical outer surface 12*b* of the return spring holder 12 is supported radially by an inner surface 15*a* of the cover 15. In this structure, the return springs 13 of the pair are arranged mutually symmetrically with respect to the rotational axis of the body 2 so that forces generated between the body and the return spring holder 12 form a balancing couple of the forces to decrease a contact force between the spherical outer surface 12*b* and the inner surface 15*a* so that a friction therebetween is decreased. Further, the outer surface 12*b* of the return spring 12 is made spherical and a radial clearance is formed between each of the torque transmission pins 14 and corresponding one of the elongated hole 8*b* so that forces generated between the brake disk 8 and the return springs 13 form a balancing couple of the forces to decrease a load between the body and the brake disk to be borne by the bearing so that friction is decreased.

In the above structure, by controlling the braking torque by changing the electric current applied to the magnetically energizing coil 10*a* of the hysteresis brake, a rotational positional relationship between the brake disk 8 and the body 2 or a rotational positional relationship between the keeper 7 and the body 2 can be adjusted freely through the return spring 13 whose torque is variable in accordance with the rotational positional relationship.

With making reference to FIGS. 4 and 5, a process of controlling a valve timing in the first embodiment will be explained. In FIGS. 4 and 5, elements for forming wedge engagement are shown in cross sectional views seen from a front side of the engine. Incidentally, a direction in which the elements for forming the wedge engagement are seen in FIG. 2 as the cross sectional view taken along B—B in FIG. 1 is opposite to the direction in which the elements for forming wedge engagement are seen in FIGS. 4 and 5.

Further, FIGS. 4 and 5 are obtained by seeing them when rotating together with the sprocket 1, so that in these drawing, a rotational phase advance of a combination of the cam shaft 3 and the body 1 is obtained when it rotates clockwise, and a rotational phase lag thereof is obtained when it rotates anti-clockwise. Incidentally, since a cross sectional shape of the body 2 in FIGS. 4 and 5 cannot be directionally identified, a flag-mark is fixed to an outer circumferential position thereof so that its circumferential movement is made visible.

At first, a process of changing the cam shaft rotational phase or valve timing to the rotational phase advance side will be explained with making reference to FIG. 4. At a start position, since a torque by the hysteresis brake and a torque by the return spring 13 are balanced with each other so that the keeper 7 is stationary with respect to the body 2 and the wedge engagements of the shim elements 5 at both sides of the keeper 7 are not released, a relative position between the sprocket 1 and the body 2 (cam shaft 3) is not changed.

Next drawing shows a situation in which the braking torque of the hysteresis brake is increased. Since all of the elements in this drawing obtained by seeing from the front side rotate clockwise, the keeper 7 is rotated anti-clockwise with respect to the body by an increased value of the braking torque so that the wedge engagement of the shim elements facing to the keeper 7 in the anti-clockwise direction is released. In this drawing, this release of the wedge engagement makes the body 2 (cam shaft 3) movable only clockwise, that is, for the rotational phase advance with respect to the sprocket 1.

Third drawing shows a situation in which the body 2 (cam shaft 3) moves for the rotational phase advance with respect to the sprocket 1. A difference between second and third drawings is, as shown by a position of the flag mark, that the body rotates clockwise and a torque for rotationally driving the keeper 7 as shown by a dimension of an arrow mark in the vicinity of the keeper 7 is decreased. As described before, a torque applied to the cam shaft 3 changes alternately to positive and negative so that the body rotates when the changing torque is negative, and the wedge engagement at only one side is released to enable the body 2 to rotate only clockwise or for the rotational phase advance as shown in the second drawing. Incidentally, the direction of the torque applied to the cam shaft 3 for moving for the rotational phase lag with respect to the sprocket 1 is positive, and the direction for moving for the rotational phase advance is negative. The increase of the torque of the return spring 13 caused by the increase of relative rotational movement between the keeper 7 and the body 2 absorbs a part of the increase of the braking torque of the hysteresis brake in the second drawing, so that a value of the torque for rotationally driving the keeper 7 as shown by the arrow mark is decreased. Incidentally, since the remainder part of the increase of the braking torque of the hysteresis brake releases the wedge engagement in the one direction, the rotation of the body 2 for the rotational phase advance is continued.

The fourth or final drawing shows a situation in which the body 2 is kept stably stationary after the increase of the braking torque for the rotational phase advance of the body 2 in the second drawing. The position of the flag mark has been further rotated for the rotational phase advance in the fourth or final drawing in comparison with the third drawing, so that the torque of the return spring 13 is further increased to be balanced with the increased braking torque. In this position, the sprocket 1 and the body 2 form the wedge engagement therebetween in both directions opposite to each other by the shim elements 5. If the body 2 is further rotated for the rotational phase advance, the torque of the return spring becomes greater than the braking torque, so that the direction of the torque applied to the keeper 7 is reversed in comparison with the direction shown in the second and third drawings to release the wedge engagement for the reverse direction. Therefore, the body 2 returns to the position shown in the final drawing, so that the body 2 is moved for the rotational phase advance by a degree corresponding to the increase of the braking torque, and automatically made stable.

With making reference to FIG. 5, a process of changing the valve timing to the rotational phase lag side will be explained. A first drawing is a start position similarly to FIG. 4.

Next drawing shows a situation in which the braking torque of the hysteresis brake is decreased. Since all of the elements in this drawing obtained by seeing from the front side rotate clockwise, the keeper 7 is rotated clockwise with respect to the body by a decreased value of the braking torque so that the wedge engagement of the shim elements facing to the keeper 7 in the clockwise direction is released. In this drawing, this release of the wedge engagement makes the body 2 (cam shaft 3) movable only anti-clockwise, that is, for the rotational phase lag with respect to the sprocket 1.

Third drawing shows a situation in which the body 2 (cam shaft 3) moves for the rotational phase lag with respect to the sprocket 1. A difference between second and third drawings is, as shown by the position of the flag mark, that the body rotates anti-clockwise and the torque for rotationally driving the keeper 7 as shown by the dimension of the arrow mark in the vicinity of the keeper 7 is decreased. As described before, the torque applied to the cam shaft 3 changes alternately to positive and negative so that the body rotates when the changing torque is positive, and the wedge engagement at only one side is released to enable the body 2 to rotate only anti-clockwise or for the rotational phase lag as shown in the second drawing. Incidentally, the direction of the torque applied to the cam shaft 3 for moving for the rotational phase lag with respect to the sprocket 1 is positive, and the direction for moving for the rotational phase advance is negative. The decrease of the torque of the return spring 13 caused by the decrease of relative rotational movement between the keeper 7 and the body 2 absorbs a part of the decrease of the braking torque of the hysteresis brake in the second drawing, so that the value of the torque for rotationally driving the keeper 7 as shown by the arrow mark is decreased. Incidentally, since the remainder part of the decrease of the braking torque of the hysteresis brake releases the wedge engagement in the other direction, the rotation of the body 2 for the rotational phase lag is continued.

The fourth or final drawing shows a situation in which the body 2 is kept stably stationary after the decrease of the braking torque. The position of the flag mark has been further rotated for the rotational phase lag in the fourth or final drawing in comparison with the third drawing, so that the torque of the return spring 13 is further decreased to be balanced with the decreased braking torque. In this position, the sprocket 1 and the body 2 form the wedge engagement therebetween in both directions opposite to each other by the shim elements 5. If the body 2 is further rotated for the rotational phase lag, the torque of the return spring becomes smaller than the braking torque, so that the direction of the torque applied to the keeper 7 is reversed in comparison with the direction shown in the second and third drawings to release the wedge engagement for the reverse direction. Therefore, the body 2 returns to the position shown in the final drawing, so that the body 2 is moved for the rotational phase lag by a degree corresponding to the decrease of the braking torque, and automatically made stable.

Therefore, in the first embodiment, the rotational phase of the body 2 or com shaft 3 with respect to the sprocket 1 is changed to either of the rotational phase advance and lag sides by changing the value of the value of the braking torque. In this condition, an energy source for the relative rotational movement is a variable torque applied to the cam shaft, and the braking torque is a trigger for taking out the variable torque as the driving power, so that a needed torque and power may be small. Further, since the rotational displacement of the keeper 7, that is, the sprocket 1, with respect to the body 2, can be increased by the increase of the braking torque, an adjustable range of the cam shaft rotational phase can be increased without an increase in size of the apparatus. Further, as known from FIG. 5, since the rotational phase of the cam shaft is necessarily changed automatically by decreasing the braking torque to zero, to the rotational phase lag in which a stable start of the engine is maintained at an intake valve, a fail-safe characteristic of the cam shaft rotational phase adjustor for the intake valve is obtained to improve a reliability.

In the above embodiment, a cam shaft rotational phase adjusting apparatus comprising a first rotary member rotationally driven synchronously by a crank shaft of an engine and a second rotary member rotationally driven by the first rotary member and connected to a cam shaft, wherein a relative rotational position between the first and second rotary members is adjusted to change a rotational phase of the cam shaft with respect to the rotational phase of the crank shaft so that an opening and closing timing of an intake or exhaust valve is changed, has the following features.

One of the first and second rotary member has a cylindrical surface, and the other one thereof has a closed loop surface including a plurality of flat surfaces facing to the cylindrical surface so that wedge-shaped clearances are arranged circumferentially between the cylindrical surface and the flat surfaces, shim members are arranged in the wedge-shaped clearances, and elastic members are arranged to press the shim members into the wedge-shaped clearances to hold the first and second rotary members with respect to each other.

A brake is arranged to apply a braking torque to a brake disk.

A third rotary member is arranged to rotate with the first rotary member, and pressing one of the shim members of each pair against an elastic force of the elastic member to be selectively released from an wedge engagement.

A return spring is incorporated between the third rotary member and the one of the first and second rotary member having the cylindrical surface to apply a rotational torque to the third rotary member, and a braking torque transmission means is arranged to transmit the braking torque of the brake to the third rotary member through the brake disk against rotation of the third rotary member.

The third rotary member releases the wedge engagement of the rotational phase advance side to change the relative rotational phase of the second rotary member to the rotational phase advance side when the braking torque increases, the third rotary member releases the wedge engagement of the rotational phase lag side to change the relative rotational phase of the second rotary member to the rotational phase lag side when the braking torque decreases, and the wedge engagement for both of the directions are formed when the braking torque is balanced with the torque of the return spring applied to the third rotary member.

The third rotary member releases the wedge engagement of the rotational phase advance side in consideration of the rotational phase so that the second rotary member has the relative rotational phase of advance side against the torque of the return spring when the braking torque increases, the third rotary member releases the wedge engagement of the rotational phase lag side so that the second rotary member has the relative rotational phase of lag side against the torque of the return spring when the braking torque decreases, and the third rotary member forms the wedge engagement for both of the directions when the braking torque is balanced with the torque of the return spring applied to the third rotary member.

In this case, the brake applies the braking torque to the first rotary member through the brake disk. Further, the third rotary member is braked by the brake disk.

The shim members have wedge shapes at front ends for the above mentioned wedge shape.

[Second Embodiment]

Figure 6:
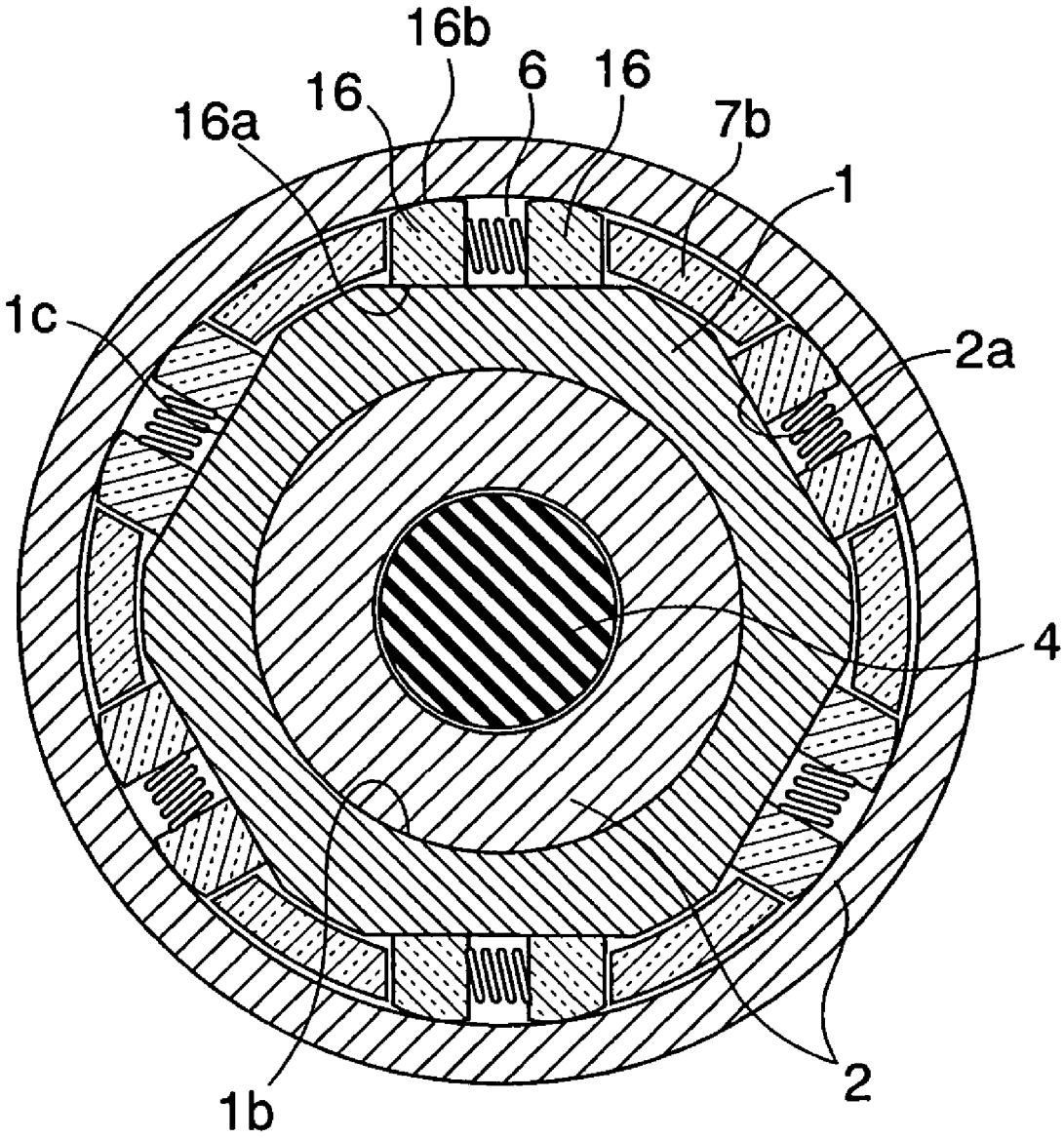
FIG. 6 is a partially cross sectional view showing an wedge engagement portion in a second embodiment of the invention.

A second embodiment of the invention is explained along FIG. 6. FIG. 6 shows only the wedge engagement of the second embodiment corresponding to FIG. 4 or 5 of the first embodiment, and is different from the first embodiment in cross sectional shape of the shim members 16 while the other structure is equal to that of the first embodiment. Explanation about the common structure is usable from the explanation of the first embodiment. The shim members 16 have straight portions 16*a* and great curvature radius portions 16*b* in cross sectional shape while the shim members 5 of the first embodiment have circular in cross sectional shape, particularly, a curvature radius of the great curvature radius portions 16*b* is significantly greater than the radius of the shim members 5 and close to an inner radius of the cylindrical surface 2*a*. On the wedge engagement, the straight portions 16*a* contact the flat surfaces 1*c* of the sprocket 1, and the great curvature radius portions 16*b* contact the cylindrical surface 2*a* of the body 2.

On a contact between two members having respective curvature radii, the smaller a difference in radius between the members is, the smaller a local Hertzian stress at the contact region is. In the wedge engagement of the second embodiment, a line contact between the curvature radii closer to an area contact is formed, whereby the maximum Hertzian stress is decreased by the above reason to obtain the cam shaft rotational phase adjustor of higher reliability.

[Third Embodiment]

Figure 7:
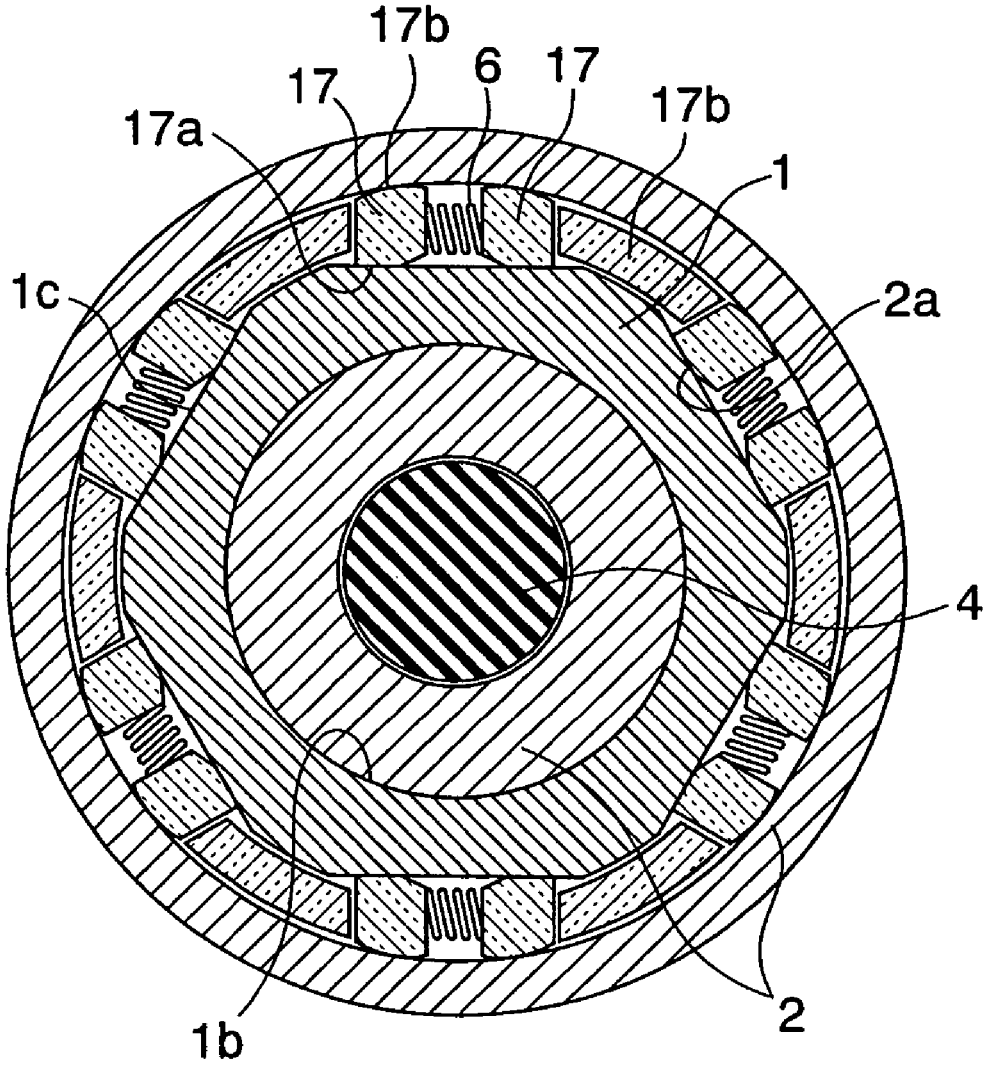
FIG. 7 is a partially cross sectional view showing an wedge engagement portion in a third embodiment of the invention.

A third embodiment of the invention is explained along FIG. 7. The third embodiment in FIG. 7 is different from the first embodiment in that cross sectional shape of shim members 17 are changed. The shim members 17 has in its cross section great curvature radius portions 17*a* and great curvature radius portions 17*b* significantly greater than the radius of the cylindrical shim members 5. In the wedge engagement, the great curvature radius portions 17*a* contact the flat surfaces 1*c* of the sprocket 1 and the great curvature radius portions 17*b* contact the cylindrical surface 2*a* of the body 2, whereby the maximum Hertzian stress is decreased similarly to the second embodiment to obtain the cam shaft rotational phase adjustor of higher reliability.

[Fourth Embodiment]

Figure 8:
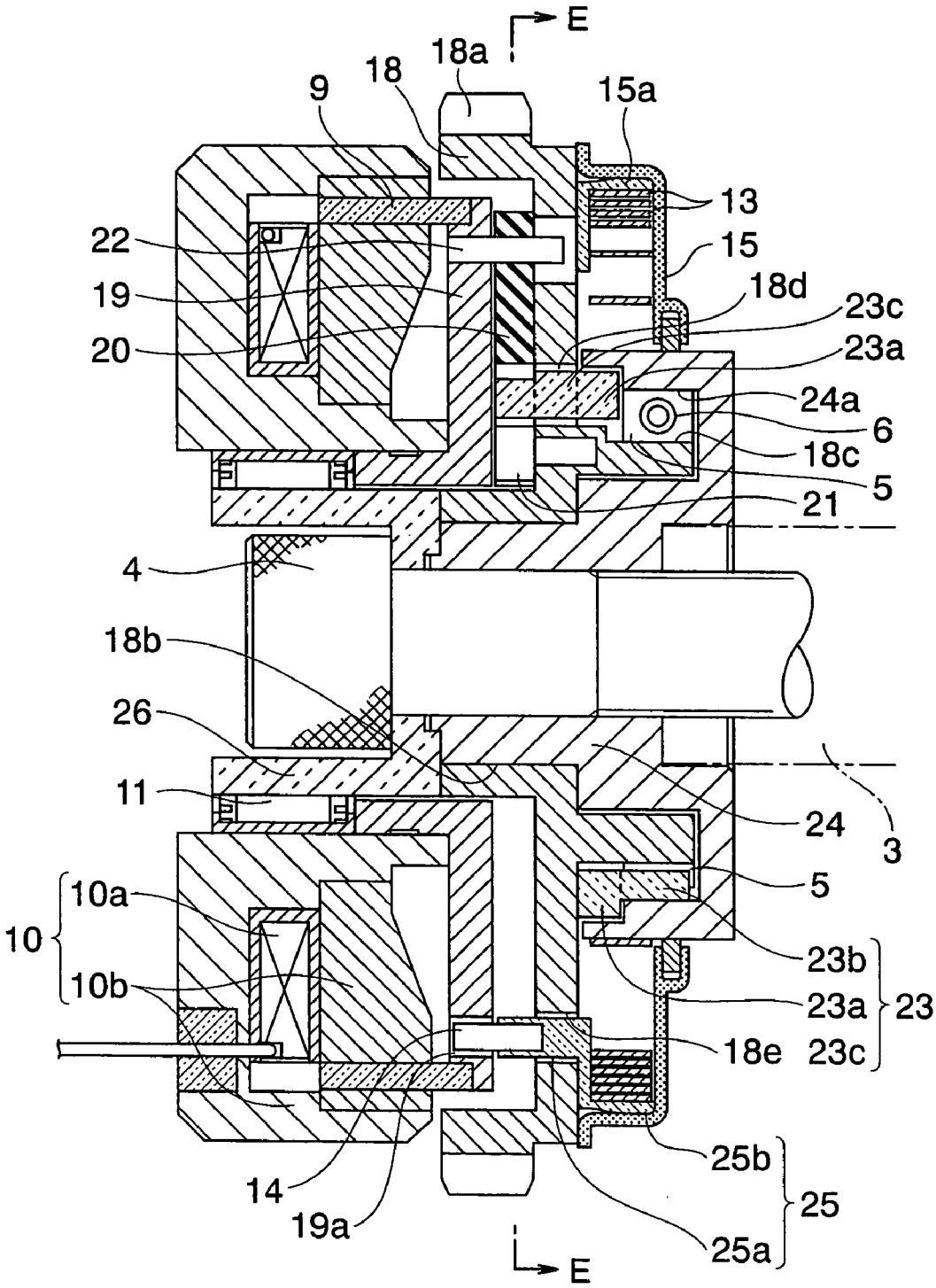
FIG. 8 is a cross sectional side view of a cam shaft rotational phase adjusting device as a fourth embodiment of the invention.
Figure 9:
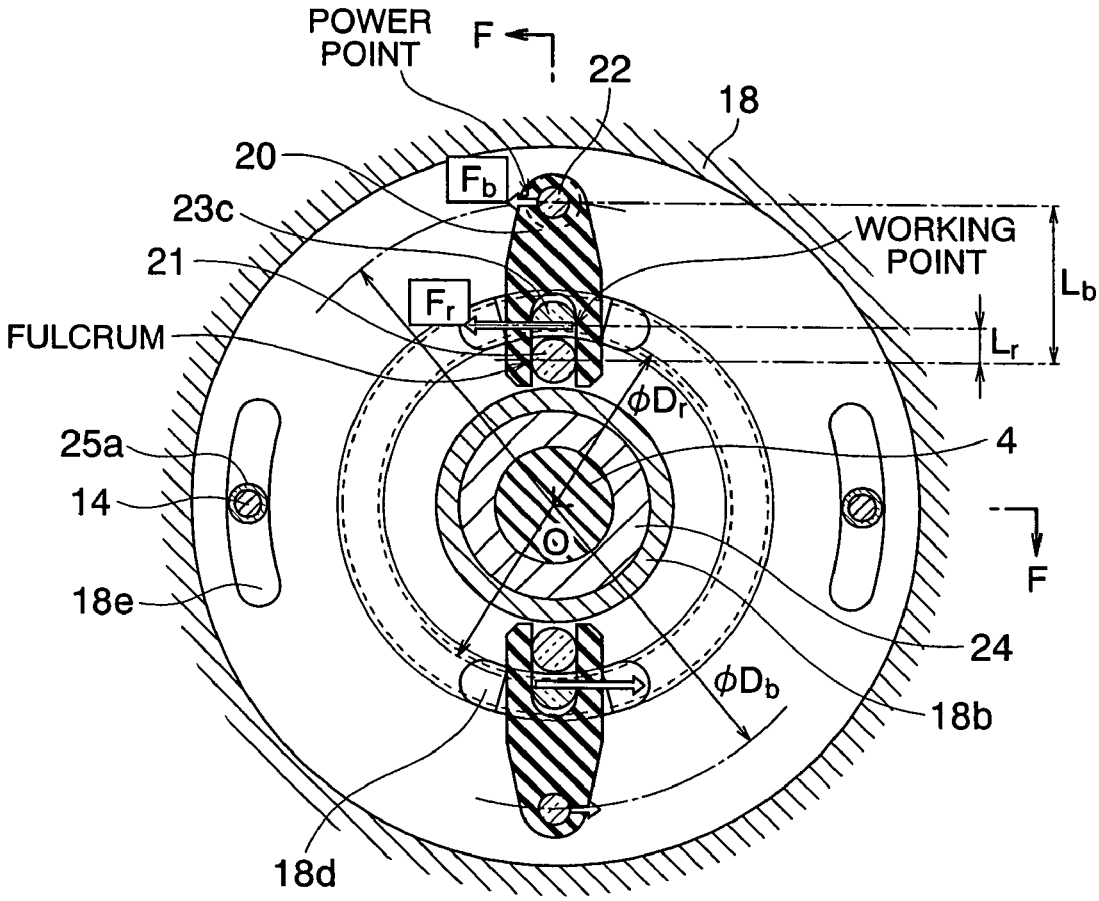
FIG. 9 is a cross sectional side view of the cam shaft rotational phase adjusting device as the fourth embodiment of the invention, taken along G—G in FIG. 8.

FIGS. 8 and 9 show a fourth embodiment of the invention. Hereafter, a difference in structure relative to the first embodiment is mainly explained. In the fourth embodiment, a pair of lever members 20 is incorporated between the sprocket 18 and the brake disk 19. Each of the lever members 20 has a fulcrum contacting a fulcrum pin 21 fixed to the sprocket 18, a power point linked to a connecting pin 22 of the brake disk 19, and a working point contacting a torque transmission part 23*c* of the keeper 23. When a distance between the fulcrum and the power point is Lb and a distance between the fulcrum and the working point is Lr in FIG. 9, a tangential force Fb applied to the power point is magnified by $$L_b/L_r$$

to be applied as a tangential force Fr to the working point. Further, when a diameter between the power points of a pair is ϕ Db, and a diameter of the working points of a pair is ϕ Dr, a torque of the hysteresis brake needed to generate a couple of forces at the power points $$Fb \cdot Db$$

is, when a couple of the forces at the working points is $$Fr \cdot Dr,$$

magnified by $$L_b/L_r \cdot D_r/D_b$$

to drive the keeper 23 through the torque transmission portions 23*c*. In FIG. 9, although $$D_r/D_b$$

is smaller than 1, since $$L_b/L_r$$

is significantly great value, the torque of the hysteresis brake is magnified to drive the keeper 23. That is, by incorporating the lever mechanism as in the fourth embodiment, the torque of the brake needed to release the wedge engagement is decreased so that a size and weight of the brake may be decreased. The braking torque decreased by taking out the variable torque of the can shaft 3 to be used as the power is further decreased by the structure of the fourth embodiment.

According to the above structure, in a cam shaft rotational phase adjustor for an internal combustion engine comprising a first rotary member rotationally driven synchronously by a crank shaft of an engine, and a second rotary member rotationally driven by the first rotary member and connected to a cam shaft, wherein a relative rotational position(relative rotational phase) between the first and second rotary members is adjusted to change a rotational phase of the cam shaft with respect to a rotational phase of the crank shaft so that an opening and closing timing of an intake or exhaust valve is changed, one of the first and second rotary members has a cylindrical surface, the other one thereof has a closed loop surface including a plurality of flat surfaces facing to the cylindrical surface so that wedge-shaped clearances opposite to each other in a circumferential direction are formed between the cylindrical surface and the flat surfaces, shim members are arranged in the wedge-shaped clearances respectively, elastic members are arranged to press the shim members to constrain the first and second rotary members, a brake applies a braking torque to a brake disk, the adjustor comprises, a third rotary member rotating substantially with the first rotary member and pressing some of the shim members in the wedge engagement against an elastic force of the elastic members to be released selectively from the wedge engagement in accordance with a direction of the braking force, a return spring arranged between the third rotary member and one of the first and second rotary members having the cylindrical surface to apply a rotational torque to the third rotary member, and a brake torque transmission means transmitting the braking torque of the brake through the brake disk to the third rotary member against the rotation thereof.

One of the first and second rotary members having the flat surfaces has a fixed fulcrum, a power point is arranged on the brake disk, and a working point is arranged on the brake torque transmission means, so that a cam shaft rotational phase adjustor for an internal combustion engine with a lever is formed.

Figure 10B:
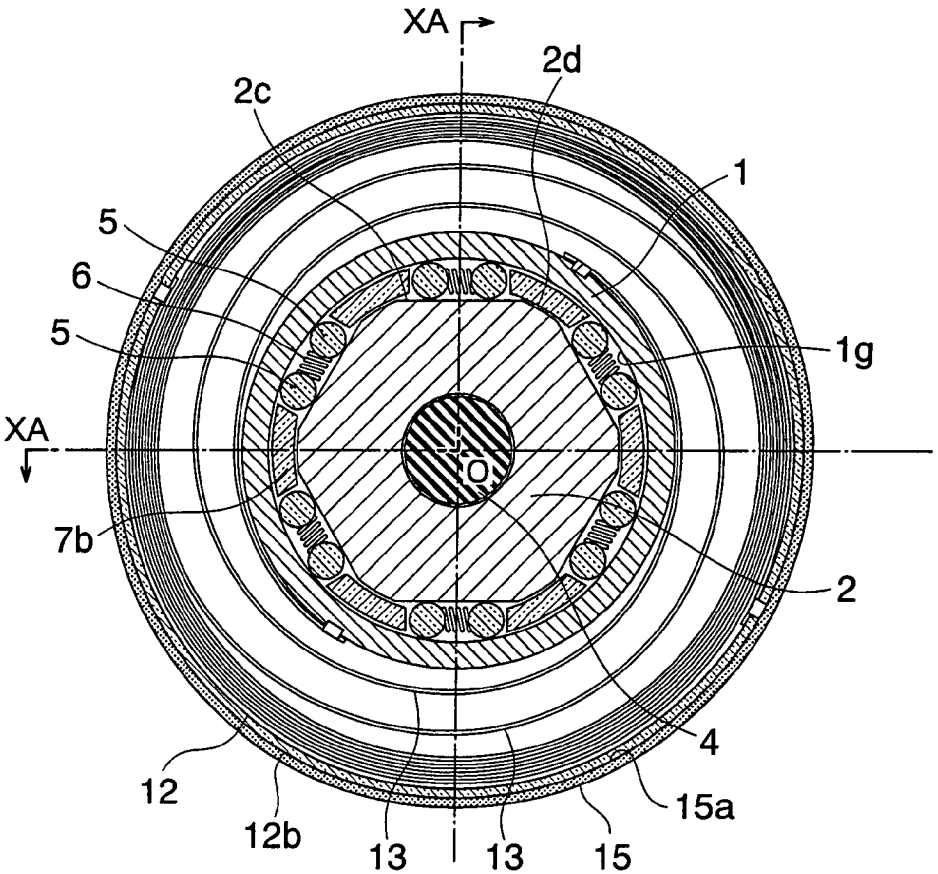
FIGS. 10A and 10B are cross sectional views showing another alternative embodiment of the invention in which the keeper as the claims fourth element is elastically supported on the sprocket as the claimed first member through the return spring as the claimed elastic element so that a positional relationship between the keeper and the sprocket is elastically variable in accordance with the braking force applied to the keeper, and the cylindrical surface portion is formed on the sprocket while the cam surface 1*d* including a plurality of the flat surface portions is formed on the body, that is, in the another alternative embodiment, the claimed one of the claimed first and second rotary members is the sprocket and the other one of the claimed first and second rotary members is the body.
Figure 10A:
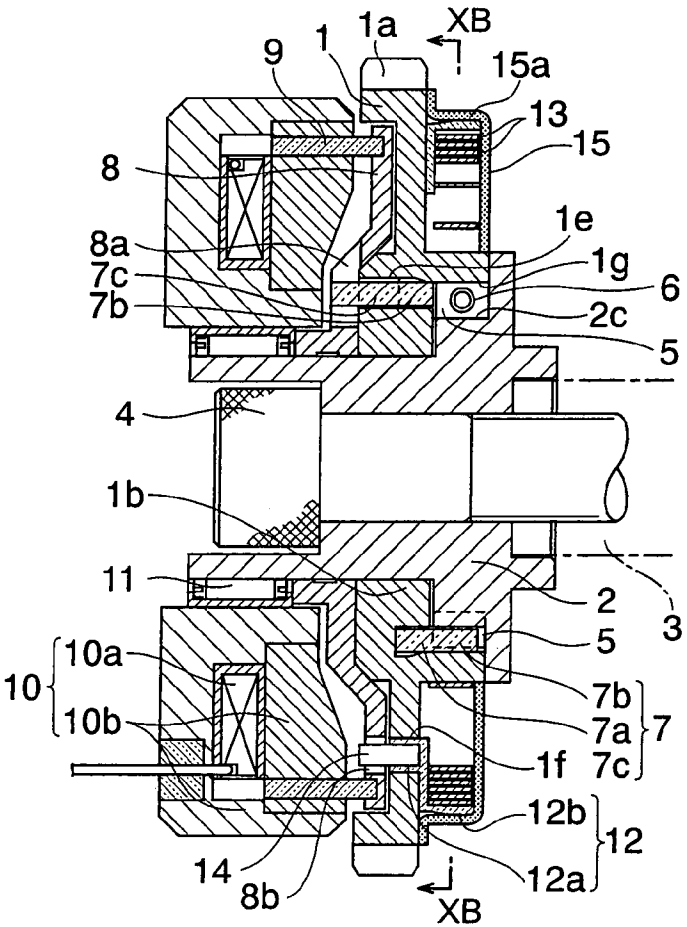

In another embodiment as shown in FIGS. 10A and 10B, the keeper 7 as the claims fourth element is elastically supported on the sprocket 1 as the claimed first member through the return spring 13 as the claimed elastic element so that a positional relationship between the keeper 7 and the sprocket 1 is elastically variable in accordance with the braking force applied to the keeper 7, and the cylindrical surface portion is formed on the sprocket 1 while the cam surface 1*d* including a plurality of the flat surface portions is formed on the body 2, that is, in this another alternative embodiment, the claimed one of the claimed first and second rotary members is the sprocket 1 and the other one of the claimed first and second rotary members is the body 2, contrary to the above described other embodiment in which the keeper 7 as the claims fourth element is elastically supported on the body 2 as the claimed second member through the return spring 13 as the claimed elastic element so that a positional relationship between the keeper 7 and the body 2 is elastically variable in accordance with the braking force applied to the keeper 7, and the cylindrical surface portion is formed on the body 2 while the cam surface 1*d* including a plurality of the flat surface portions is formed on the sprocket 1.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A rotational phase adjusting apparatus for adjusting a difference in rotational phase between a rotating member and a driven member rotationally driven by the rotating member, comprising:

a first element capable of being connected to the rotating member so that the first element is rotationally driven by the rotating member, a second element capable of being connected to the first element and the driven member so that the driven member is rotationally driven through the second element by the first element, a third element capable of being set at either of a first condition at which first condition the third element is compressed between the first and second elements to prevent the first and second elements from rotating with respect to each other and a second condition at which second condition the third element is released from at least one of the first and second elements to allow the first and second elements to rotate with respect to each other, and a fourth element rotatable with respect to one of the first and second elements and facing to the third element so that the fourth element is capable of setting the third element at selected one of the first and second conditions, wherein the apparatus further comprises:

an elastic member arranged between the fourth element and the one of the first and second elements to enable a rotational positional relationship between the fourth element and the one of the first and second elements to be elastically variable, and a brake for generating a variable braking force to be applied to the fourth element so that the rotational positional relationship between the fourth element and the one of the first and second elements and a value of a force applicable from the fourth element to the third element are elastically variable in accordance with a value of the variable braking force, when the first element is rotationally driven by the rotating member, the fourth element is rotationally driven by the one of the first and second elements through the elastic member and the fourth element is braked by the variable braking force.

2. A rotational phase adjusting apparatus according to claim 1, wherein a relative rotational movement between the fourth element and the other one of the first and second elements is limited in a predetermined degree.

3. A rotational phase adjusting apparatus according to claim 2, wherein the rotating member is a crank shaft of a combustion engine, the driven member is a cam shaft of the combustion engine, and the elastic element is arranged between the fourth element and the one of the first and second elements in such a manner that a force generated by the elastic element to be applied through the fourth element to the other one of the first and second elements is capable of rotating the other one of the first and second elements with respect to the one of the first and second elements to rotate the first element forward with respect to the second element in a rotary direction of the first element, when the braking force is not more than a predetermined value.

4. A rotational phase adjusting apparatus according to claim 1, wherein the rotating member is a crank shaft of a combustion engine, the driven member is a cam shaft of the combustion engine, and the force generated by the elastic element to be applied from the fourth element to the third element sets the third element at the second condition to allow the first element to rotate forward with respect to the second element in a rotary direction of the first element, when the braking force is not more than a predetermined value.

5. A rotational phase adjusting apparatus according to claim 1, wherein the apparatus comprises a pair of the third elements, one of which third elements capable of being set at either of the first condition at which first condition the third element is compressed between the first and second elements to prevent the first element from rotating forward with respect to the second element in a rotary direction of the first element and the second condition at which second condition the third element is released from at least one of the first and second elements to allow the first element to rotate forward with respect to the second element in the rotary direction of the first element, and the other one of which third elements capable of being set at either of the first condition at which first condition the third element is compressed between the first and second elements to prevent the first element from rotating backward with respect to the second element in the rotary direction of the first element and the second condition at which second condition the third element is released from at least one of the first and second elements to allow the first element to rotate backward with respect to the second element in the rotary direction of the first element.

6. A rotational phase adjusting apparatus according to claim 5, wherein the fourth element faces to each of the third elements so that the fourth element is capable of setting the one of the third elements at selected one of the first and second conditions and setting the other one of the third elements at the other one of the first and second conditions other than the selected one of the first and second conditions, and the value of the force applicable from the fourth element to the third elements is variable in accordance with the value of the braking force to set the third elements at respective ones of the first and second conditions different from each other.

7. A rotational phase adjusting apparatus according to claim 6, wherein the fourth element faces to each of the third elements so that the fourth element is capable of setting each of the third elements at the first condition, the value of the force applicable from the fourth element to the third elements is variable in accordance with the value of the braking force to set each of the third elements at the first condition, and the value of the force applicable from the fourth element to the third elements when each of the third elements is set at the first condition is an intermediate value between the value of the force applicable from the fourth element to the third elements when the one of the third elements is set at the first condition and the other one of the third elements is set at the second condition and the value of the force applicable from the fourth element to the third elements when the one of the third elements is set at the second condition and the other one of the third elements is set at the first condition.

8. A rotational phase adjusting apparatus according to claim 5, wherein the rotating member is a crank shaft of a combustion engine, the driven member is a cam shaft of the combustion engine.

9. A rotational phase adjusting apparatus according to claim 8, wherein the fourth element sets the one of the third elements at the second condition thereof, and sets the other one of the third elements at the first condition thereof, when the braking force is not more than a predetermined value.

10. A rotational phase adjusting apparatus according to claim 5, further comprising another elastic element between the third elements of the pair to urge the third elements toward each of the first and second elements in respective directions opposite to each other.

11. A rotational phase adjusting apparatus according to claim 1, further comprising a lever swingable on an axis arranged on one of the first and second elements, wherein a distance between the axis and a point on the lever at which point the braking force is applied from the brake to the lever is larger than a distance between the axis and another point on the lever at which point the braking force is applied to the fourth element from the lever so that a force amplified in comparison with the braking force generated by the brake is applied to the fourth element.

12. A rotational phase adjusting apparatus according to claim 1, wherein the first and second elements form an wedge shaped clearance therebetween into which the third element is pressed to be compressed between the first and second elements at the first condition, and from which the third element is released to be released from at least one of the first and second elements at the second condition.

13. A rotational phase adjusting apparatus according to claim 1, wherein the fourth element is rotatable with respect to the first element, and the elastic member is arranged between the fourth element and the first element.

14. A rotational phase adjusting apparatus according to claim 13, wherein a relative rotational movement between the fourth element and the second element is limited in a predetermined degree.

15. A rotational phase adjusting apparatus according to claim 1, wherein the fourth element is rotatable with respect to the second element, and the elastic member is arranged between the fourth element and the second element.

16. A rotational phase adjusting apparatus according to claim 15, wherein a relative rotational movement between the fourth element and the first element is limited in a predetermined degree.

17. A rotational phase adjusting apparatus according to claim 1, wherein the fourth element extends through the other one of the first and second elements with a clearance between the fourth element and the other one of the first and second elements so that the braking force is transmitted to the fourth element through the other one of the first and second elements.

* * * * *